US007181929B2

(12) United States Patent
Watanabe

(10) Patent No.: US 7,181,929 B2
(45) Date of Patent: Feb. 27, 2007

(54) FINNED TUBE FOR HEAT EXCHANGERS, HEAT EXCHANGER, APPARATUS FOR FABRICATING HEAT EXCHANGER FINNED TUBE AND PROCESS FOR FABRICATING HEAT EXCHANGER FINNED TUBE

(75) Inventor: Isao Watanabe, Oyama (JP)

(73) Assignee: Showa Denko K.K., Tokyo (JP)

( * ) Notice: Subject to any disclaimer, the term of this patent is extended or adjusted under 35 U.S.C. 154(b) by 48 days.

(21) Appl. No.: 10/538,091

(22) PCT Filed: Dec. 9, 2003

(86) PCT No.: PCT/JP03/15701

§ 371 (c)(1),
(2), (4) Date: Jun. 8, 2005

(87) PCT Pub. No.: WO2004/053414

PCT Pub. Date: Jun. 24, 2004

(65) Prior Publication Data

US 2006/0059946 A1 Mar. 23, 2006

Related U.S. Application Data

(60) Provisional application No. 60/440,373, filed on Jan. 16, 2003.

(30) Foreign Application Priority Data

Dec. 10, 2002 (JP) ..... 2002-357466

(51) Int. Cl.
*F25B 39/02* (2006.01)

(52) U.S. Cl. ..... 62/515; 165/142; 165/151

(58) Field of Classification Search ..... 165/142, 165/151, 179; 62/515
See application file for complete search history.

(56) References Cited

U.S. PATENT DOCUMENTS

| | | | | |
|---|---|---|---|---|
| 6,348,761 | B1 * | 2/2002 | Nomura et al. | 313/495 |
| 6,578,628 | B1 * | 6/2003 | Garosshen | 165/133 |
| 6,928,833 | B2 * | 8/2005 | Watanabe et al. | 62/515 |

FOREIGN PATENT DOCUMENTS

| | | |
|---|---|---|
| JP | 4-279234 | 10/1992 |
| JP | 9-253775 | 9/1997 |
| JP | 2002-282972 | 10/2002 |

* cited by examiner

*Primary Examiner*—Melvin Jones
(74) *Attorney, Agent, or Firm*—Oblon, Spivak, McClelland, Maier & Neustadt, P.C.

(57) ABSTRACT

A plurality of fin groups 12 each comprising parallel plate fins 14 are arranged on two straight tube portions 11*a* of a fin fixing hairpin tube 11 longitudinally of the tube portions at a spacing, by forming two tube inserting holes 14*a* as spaced apart in each of the plate fins 14 and inserting the two straight tube portions 11*a* through the respective holes 14*a* of the plate fins 14. The hairpin tube 11 is enlarged with use of a fluid to fixedly fit the plate fins 14 of the fin groups 12 around the straight tube portions 11*a* of the tube 11. The straight tube portions 11*a* of the tube 11 each have a finless part 13 provided between each pair of adjacent fin groups 12. The finless part 13 of each straight tube portion 11*a* bears clamp marks 19 on the outer peripheral surface thereof. A heat exchanger comprising a heat exchanger finned tube 10 thus constructed is adapted to diminish leakage of the refrigerant and achieves a desired refrigeration efficiency.

22 Claims, 11 Drawing Sheets

FINNED TUBE FOR HEAT EXCHANGERS, HEAT EXCHANGER, APPARATUS FOR FABRICATING HEAT EXCHANGER FINNED TUBE AND PROCESS FOR FABRICATING HEAT EXCHANGER FINNED TUBE

CROSS REFERENCE TO RELATED APPLICATIONS

This application is an application filed under 35 U.S.C. §111(a) claiming the benefit pursuant to 35 U.S.C. §119(e)(1) of the filing data of Provisional Application No. 60/440,373 filed Jan. 16, 2003 pursuant to 35 U.S.C. §111(b).

TECHNICAL FIELD

The present invention relates to heat exchanger finned tubes for use in fabricating heat exchangers useful as evaporators of refrigeration devices such as refrigerators and refrigerated showcases, heat exchangers, an apparatus for fabricating the heat exchanger finned tube and a process for fabricating the heat exchanger finned tube.

BACKGROUND ART

For use in refrigerators and refrigerated showcases, studies are recently under way on the replacement of chlorofluorocarbon refrigerants by hydrocarbon refrigerants which are less likely affect the depletion of the ozone layer or global warming. Since hydrocarbon refrigerants are inflammable, leakage of the refrigerant must be diminished to the greatest possible extent.

Heat exchangers adapted to prevent leaks of the refrigerant are known which are fabricated by arranging a plurality of fin groups at a spacing, each of the fin groups comprising parallel plate fins each having two pipe inserting holes, inserting two straight outer pipes through the respective holes of all the plate fins, forcing a pipe enlarging tool through the outer pipes to enlarge the pipes and fixedly fit the plate fins around the outer pipes, inserting two straight pipe portions of an inner pipe in the form of a hairpin and comprising a pipe having no weld seam into the respective outer pipes, and bending the outer pipes and the straight pipe portions of the inner pipe at portions between the adjacent fin groups to form the pipe assembly in a zigzag shape in its entirety (see the publication of JP-A No. 2001-124485).

Since the inner pipe has no weld seam, the fluid flowing through the inner pipe, i.e., the refrigerant when the conventional heat exchanger is used as the evaporator of a refrigeration device, is prevented from leaking.

Further with the conventional heat exchanger, the inner pipe is not enlarged by the pipe enlarging tool, so that inner fins can be formed on the inner peripheral surface thereof integrally therewith, hence an increased heat transfer area to result in an improved heat exchange efficiency.

However, the conventional heat exchanger has the problem of requiring a high material cost and having great weight in its entirety since the outer pipes and the inner pipe must be used. The heat exchanger has another problem in that the insertion of the straight pipe portions of the inner pipe into the outer pipes requires cumbersome work. Moreover, it is impossible to greatly reduce the difference between the outside diameter of the inner pipe straight portions and the inside diameter of the outer pipes so as to render the inner pipe straight portions insertable into the outer pipes with an improved work efficiency. This entails the problem of impaired intimate contact between the pipe portion and the outer pipe to result in a lower heat transfer efficiency and a lower heat exchange efficiency.

With the conventional heat exchanger described, an adhesive or compound of high heat transfer properties is provided between the inner pipe straight portion and the outer pipe so as to ensure improved heat transfer therebetween. The heat exchanger therefore has the problem that the adhesive or compound is cumbersome to apply.

Accordingly, to overcome these problems, it is thought useful to provide a heat exchanger by arranging a plurality of fin groups at a spacing, each of the fin groups comprising parallel plate fins each having two tube inserting holes, inserting two straight tube portions of a hairpin tube comprising a tube having no weld seam through the respective holes of all the plate fins, forcing a pressure fluid into the hairpin tube to enlarge the tube, fixedly fit the plate fins around the straight tube portions of the hairpin tube and form a heat exchanger finned tube, and bending the hairpin tube straight portions of the finned tube at portions between the adjacent fin groups to form the finned tube in a zigzag shape in its entirety.

However, this heat exchanger has the problem that the hairpin tube ruptures at a finless portion thereof which has no fins when the tube is enlarged with the pressure fluid.

An object of the present invention is to overcome the above problems and to provided a heat exchanger finned tube which is adapted to diminish the leakage of refrigerant and to exhibit the desired refrigeration performance and which can be prevented from rupturing during fabrication, a heat exchanger, an apparatus for fabricating the heat exchanger finned tube and a process for fabricating the heat exchanger finned tube.

DISCLOSURE OF THE INVENTION

The present invention provides a first heat exchanger finned tube which has a fin fixing tube having a straight tube portion and comprising a tube having no weld seam, and a fin group comprising a plurality of parallel plate fins fixed to the straight tube portion of the fin fixing tube, the straight tube portion having at least one finless part provided with no fin group, each of the plate fin having a tube inserting hole, the fin fixing tube having its straight tube portion inserted through the holes of the plate fins and being enlarged with use of a fluid to thereby fixedly fit the plate fins around the straight tube portion, the finless part of the straight tube portion having an outer peripheral surface bearing annular clamp marks left by clamping the straight tube portion over the entire circumference thereof when the fin fixing tube is enlarged.

The heat exchanger finned tube of the present invention has a fin fixing tube comprising a tube having no weld seam, so that the heat exchanger fabricated with use of this finned tube is adapted to diminish the leakage of fluids, e.g., refrigerant. Hydrocarbon refrigerants are therefore usable which are less likely to affect the depletion of the ozone layer or global warming. Since the plate fins are fixedly fitted around the straight tube portion of the fin fixing tube by enlarging the tube with use of a fluid, the desired refrigeration efficiency (heat exchange efficiency) can be achieved even when the fin fixing tube has inner fins projecting from the inner peripheral surface thereof to a relatively great height so as to obtain an increased area of heat transfer, without the likelihood that the inner fins will be collapsed when the tube is enlarged. Furthermore, the finless part of the straight tube portion bears annular clamp marks which are left on the outer peripheral surface thereof by clamping the tube portion over the entire circumference thereof during enlargement. This indicates that the finless part is clamped over the entire circumference thereof by some means when the fin fixing tube is enlarged with the fluid. The straight tube portion is therefore prevented from rupturing during enlargement.

With the heat exchanger finned tube according to the invention, the fin fixing tube may be in the form of a hairpin, with a plurality of fin groups arranged on two straight tube portions of the fin fixing tube longitudinally thereof at a spacing, each of the fin groups comprising a plurality of parallel plate fins extending across and fixed to the two straight tube portions, each of the plate fins having two tube inserting holes spaced apart from each other, the fin fixing tube having its straight tube portions inserted through the respective holes of the plate fins, the two straight tube portions of the fin fixing tube each having the finless part between each pair of adjacent fin groups.

With the heat exchanger finned tube according to the invention, the finless part may be in excess of 5 mm in length, and portions bearing no clamp mark and included in the finless part may be up to 5 mm in length. The fin fixing tube can then be enlarged while being prevented from rupturing reliably.

With the heat exchanger finned tube according to the invention, the fin fixing tube may be integrally provided on an inner peripheral surface thereof with inner fins extending longitudinally thereof and arranged at a spacing circumferentially thereof. Thus, the fin fixing tube has inner fins formed on the inner peripheral surface thereof integrally therewith, extending longitudinally of the tube and arranged circumferentially thereof at a spacing. This gives an increased area of heat transfer to the fin fixing tube to improve the heat exchange efficiency of the heat exchanger to be fabricated using the finned tube.

With the heat exchanger finned tube according to the invention, the fin fixing tube may have high and low two kinds of inner fins alternately arranged circumferentially thereof and projecting from the inner peripheral surface of the tube to different heights, the high inner fins being 0.7 to 1.7 mm in height from the surface of the fin fixing tube, the low inner fins being 0.4 to 1.2 mm in height from the surface. All the inner fins may be equal in height and 0.7 to 1.2 mm in height from the inner peripheral surface of the fin fixing tube. In either case, it is desirable that the pitch of the inner fins be 0.4 to 1.6 mm. These features effectively improve the heat exchange efficiency of the heat exchanger to be produced with use of the finned tube.

The present invention provides a first heat exchanger comprising a heat exchanger finned tube which has a fin fixing tube having a straight tube portion and comprising a tube having no weld seam, and a fin group comprising a plurality of parallel plate fins fixed to the straight tube portion of the fin fixing tube, the straight tube portion having at least one finless part provided with no fin group, each of the plate fin having a tube inserting hole, the fin fixing tube having its straight tube portion inserted through the holes of the plate fins and being enlarged with use of a fluid to thereby fixedly fit the plate fins around the straight tube portion, the finless part of the straight tube portion having an outer peripheral surface bearing annular clamp marks left by clamping the straight tube portion over the entire circumference thereof when the fin fixing tube is enlarged, the heat exchanger finned tube being bent at said at least one finless part of the straight tube portion of the fin fixing tube.

The present invention provides a second heat exchanger comprising a heat exchanger finned tube which has a fin fixing hairpin tube having two straight tube portions and comprising a tube having no weld seam, and a plurality of fin groups arranged on the two straight tube portions of the fin fixing tube longitudinally thereof at a spacing, each of the fin groups comprising a plurality of parallel plate fins extending across and fixed to the two straight tube portions, each of the straight tube portions having at least one finless part provided with no fin group, each of the plate fins having two tube inserting holes spaced apart from each other, the fin fixing tube having its straight tube portions inserted through the respective holes of the plate fins and being enlarged with use of a fluid to thereby fixedly fit the plate fins around the straight tube portions, the two straight tube portions of the fin fixing tube each having the finless part between each pair of adjacent fin groups, the finless part of each straight tube portion having an outer peripheral surface bearing annular clamp marks left by clamping the straight tube portion over the entire circumference thereof when the fin fixing tube is enlarged, the finned tube being formed in a zigzag shape in its entirety by bending in the same direction each pair of finless parts located in the same position with respect to the longitudinal direction of the straight tube portions of the fin fixing tube, and bending in different directions each pair of finless parts adjacent to each other longitudinally of the straight tube portions.

These heat exchangers have the same advantage as already described with reference to the heat exchanger finned tube.

The present invention provides a refrigerator which comprises a refrigeration cycle having a compressor, a condenser and an evaporator, the evaporator being a heat exchanger according to claim 8 or 9, and wherein a hydrocarbon refrigerant is used as the refrigerant. With this refrigerator, the refrigerant is circulated preferably at a rate of 1 to 9 kg/h.

The present invention provides a refrigerated showcase which comprises a refrigeration cycle having a compressor, a condenser and an evaporator, the evaporator being one of the heat exchangers described above, and wherein a hydrocarbon refrigerant is used as the refrigerant. With this showcase, the refrigerant is circulated preferably at a rate of 1 to 9 kg/h.

The present invention provides an apparatus for producing a heat exchanger finned tube comprising a fin setting jig composed of a plate base and a plurality of fin support plates provided upright on the plate base and arranged in parallel at a spacing, tube clamp lower plates arranged in respective fin setting clearances between adjacent fin support plates of the fin setting jig, tube clamp upper plates arranged on the respective lower plates between the adjacent fin support plates and a pressure member for pressing the upper plates downward, each of the fin support plates having a cutout formed in an upper edge thereof for a straight tube portion of a fin fixing tube to fit in, each pair of corresponding tube clamp upper and lower plates having a through hole formed therebetween for inserting the straight tube portion of the fin fixing tube therethrough, the through hole having an inside diameter not smaller than the outside diameter of the fin fixing tube.

The production apparatus of the present invention has a relatively simple construction and is nevertheless capable of producing a heat exchanger finned tube. The tube clamp upper and lower plates act to clamp the straight tube portion of the fin fixing tube to be enlarged with a fluid, preventing the tube from rupturing during enlargement. Moreover, the apparatus is low in cost. The straight tube portion of the fin fixing tube can be prevented from rupturing while being enlarged with use of the fluid, by restraining the finless part with a restraining die approximately over the entire length thereof, but the apparatus then becomes costly. The finless part of the heat exchanger finned tube may differ in length with the type of heat exchanger, and production of finned tubes having finless parts of varying lengths necessitates preparation of restraining dies specifically for the respective finless parts of different lengths to result in increases in cost. With the production apparatus of the present invention, on the other hand, the tube to be enlarged can be prevented from rupturing merely by varying the number of tube clamp lower plates to be arranged in the fin setting clearances of the fin setting jig and the number of upper plates to be arranged on the lower plates even when the heat exchanger finned tube to be produced has a finless part of altered length. Accordingly upper and lower plates need only to be prepared in an increased number. This results in a lower cost than when various metal members must be prepared for specific use.

In the heat exchanger finned tube production apparatus of the invention, each of the fin support plates may have two cutouts formed as spaced apart in the upper edge thereof for two straight tube portions of a fin fixing hairpin tube to fit in, and each pair of corresponding tube clamp upper and lower plates may have two through holes formed therebetween for inserting the two straight tube portions of the fin fixing tube therethrough, the through holes having the same pitch as the two cutouts. In this case, the heat exchanger finned tube wherein the fin fixing tube is in the form of a hairpin as described above can be produced at a low cost without permitting the rupture of the straight tube portions of the tube.

In the heat exchanger finned tube production apparatus of the invention, the plate base of the fin setting jig may comprise a plurality of base units arranged in series, with fin support plates provided upright on each of the base units. When the fin fixing tube to be used has a straight tube portion of altered length, the apparatus is usable for this tube by altering the number of base units.

In the heat exchanger finned tube production apparatus of the invention, the tube clamp upper and lower plates may each have a thickness of 0.8 to 1.0 mm. The fin fixing tube to be enlarged with use of a fluid can then be prevented from rupturing reliably.

The present invention provides a process for producing the heat exchanger finned tube according to the invention and described above which process includes preparing a fin fixing tube having a straight tube portion and comprising a tube having no weld seam, and a plurality of plate fins each having a tube inserting hole, arranging the plate fins in respective fin setting clearances arranged in succession at a portion where a fin group is to be provided, among fin setting clearances between all fin support plates of the production apparatus described above, arranging tube clamp lower plates in the respective fin setting clearances having no plate fin disposed therein, inserting the straight tube portion of the fin fixing tube through the tube inserting holes of the plate fins and fitting the straight tube portion into cutouts of the fin support plates to provide on the straight tube portion a fin group comprising the plate fins as arranged in parallel and a finless part, arranging tube clamp upper plates on the respective tube clamp lower plates, with the straight tube portion of the tube extending through a hole formed between each pair of corresponding upper and lower plates, pressing the upper plates downward by a pressure member, and introducing a fluid into the fin fixing tube to enlarge the tube and fixedly fit the plate fins of the fin group around the straight tube portion.

In the case where the heat exchanger finned tube comprising a fin fixing hairpin tube and described above is to be produced by the process of the invention, a production apparatus is used wherein each of fin support plates has two cutouts formed in the upper edge thereof for the two straight tube portions of the fin fixing hairpin tube to fit in, and each pair of corresponding tube clamp upper and lower plates have two through holes formed therebetween for inserting the two straight tube portions of the fin fixing tube therethrough, the through holes having the same pitch as the two cutouts. The heat exchanger finned tube is produced by a process which includes preparing a fin fixing hairpin tube comprising a tube having no weld seam, and plate fins each having two tube inserting holes, arranging the plate fins in respective fin setting clearances arranged in succession at portions where respective fin groups are to be provided, among fin setting clearances between all fin support plates of the production apparatus described above, arranging tube clamp lower plates in the respective fin setting clearances having no plate fin disposed therein, inserting two straight tube portions of the fin fixing tube through the respective tube inserting holes of each of the plate fins and fitting the straight tube portions respectively into two cutouts of each of the fin support plates to provide fin groups each comprising a plurality of plate fins as arranged in parallel and finless parts, arranging tube clamp upper plates on the respective tube clamp lower plates, with the straight tube portions of the tube extending respectively through two holes formed between each pair of corresponding upper and lower plates, pressing the upper plates downward by a pressure member, and introducing a fluid into the fin fixing tube to enlarge the tube and fixedly fit the plate fins of the fin groups around the straight tube portions.

In the heat exchanger finned tube production process of the invention, suppose the hole formed between the corresponding tube clamp upper and lower plates has an inside diameter D, and the straight tube portion of the fin fixing tube before enlargement has an outside diameter d. These diameters preferably have the relationship of $d \leqq D \leqq d+0.4$ mm. Further with the process of the invention, suppose the combined area of contact of the tube clamp upper plates with the fin fixing tube is A, and the pressure of the fluid introduced into the fin fixing tube is P. Preferably, the force to be applied by the pressure member for pressing the upper plates downward is set at not smaller than $A \times P$. In these cases, the fin fixing tube can be enlarged with use of a fluid while being reliably prevented from rupturing.

With the heat exchanger finned tube production process of the invention, the fin fixing tube may be integrally provided on an inner peripheral surface thereof with inner fins extending longitudinally thereof and arranged at a spacing circumferentially thereof. Since the plate fins of the fin groups are fixedly fitted around the straight tube portions of the fin fixing tube by introducing a fluid into the tube for enlargement, the inner fins are prevented from collapsing during enlargement, enabling the heat exchanger to be produced with use of the finned tube to achieve a high heat exchange efficiency.

With the heat exchanger finned tube production process of the invention, the fin fixing tube has high and low two kinds of inner fins alternately arranged circumferentially thereof and projecting from the inner peripheral surface of the tube to different heights, the high inner fins being 0.7 to 1.7 mm in height from the surface of the fin fixing tube, the low inner fins being 0.4 to 1.2 mm in height from the surface. Further with the heat exchanger finned tube production process of the invention, all the inner fins are equal in height and 0.7 to 1.2 mm in height from the inner peripheral surface of the fin fixing tube.

BEST MODE OF CARRYING OUT THE INVENTION

Embodiments of the present invention will be described below with reference to the drawings. The term "aluminum" as used in the following description includes aluminum alloys in addition to pure aluminum. Further in the following description, the left-hand sides of FIG. 1 will be referred to as "front," the right-hand side thereof as "rear," and the upper and lower sides and left- and right-hand sides of FIGS. 2 and 6 as "upper," "lower," "left" and "right", respectively.

Figure 1:
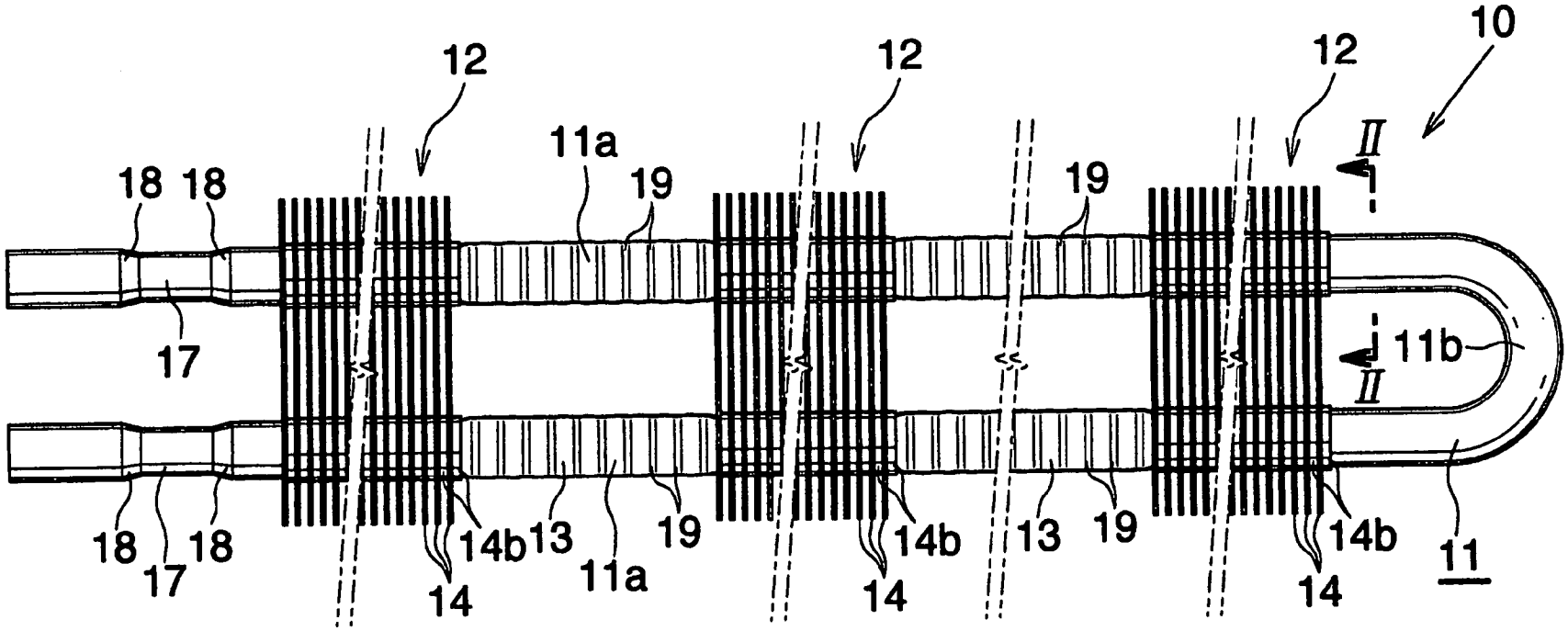
FIG. 1 is a plan view partly broken away and showing a heat exchanger finned tube according to the invention.
Figure 2:
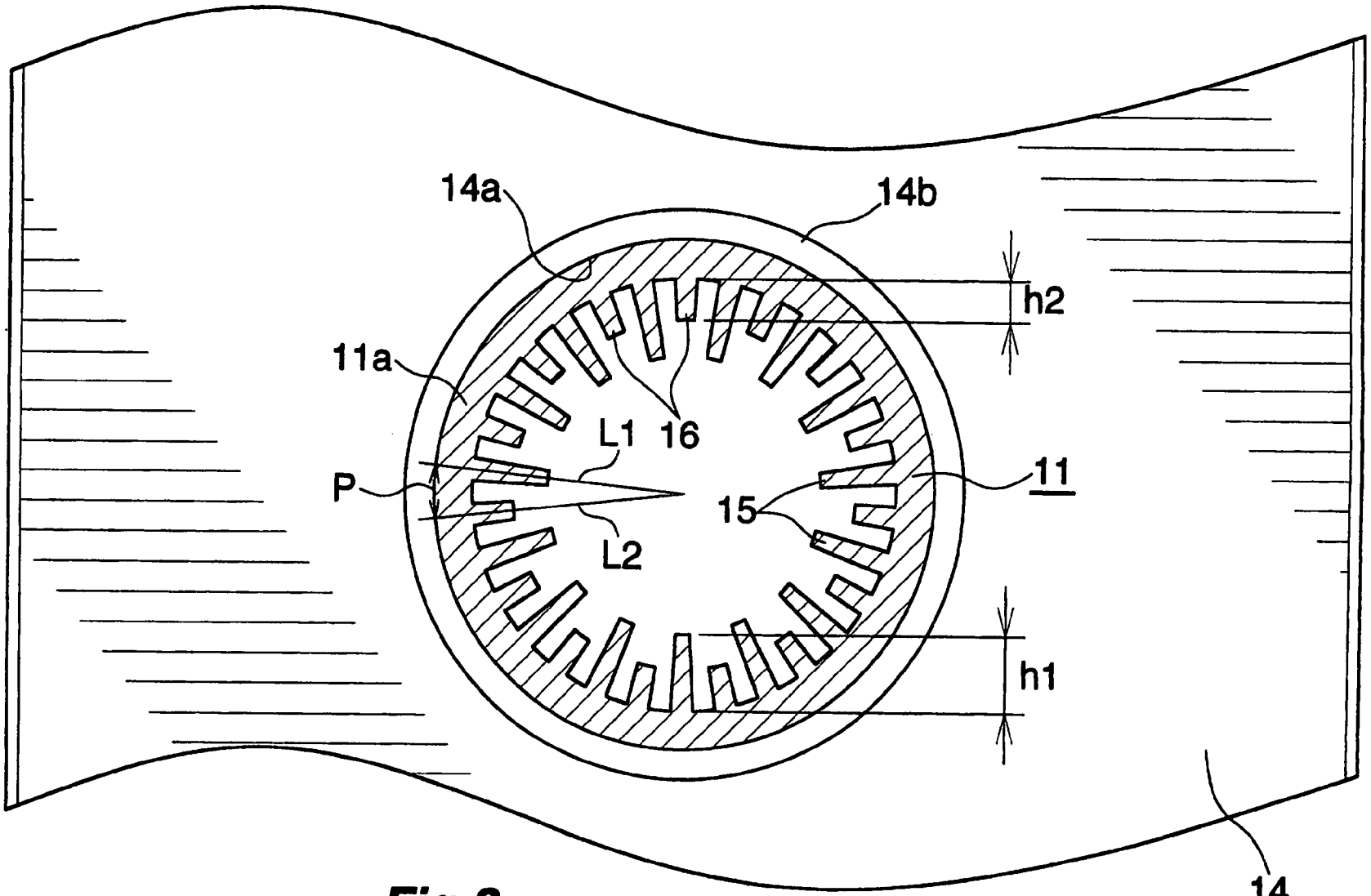
FIG. 2 is an enlarged view in section taken along the line II—II in FIG. 1.
Figure 9:
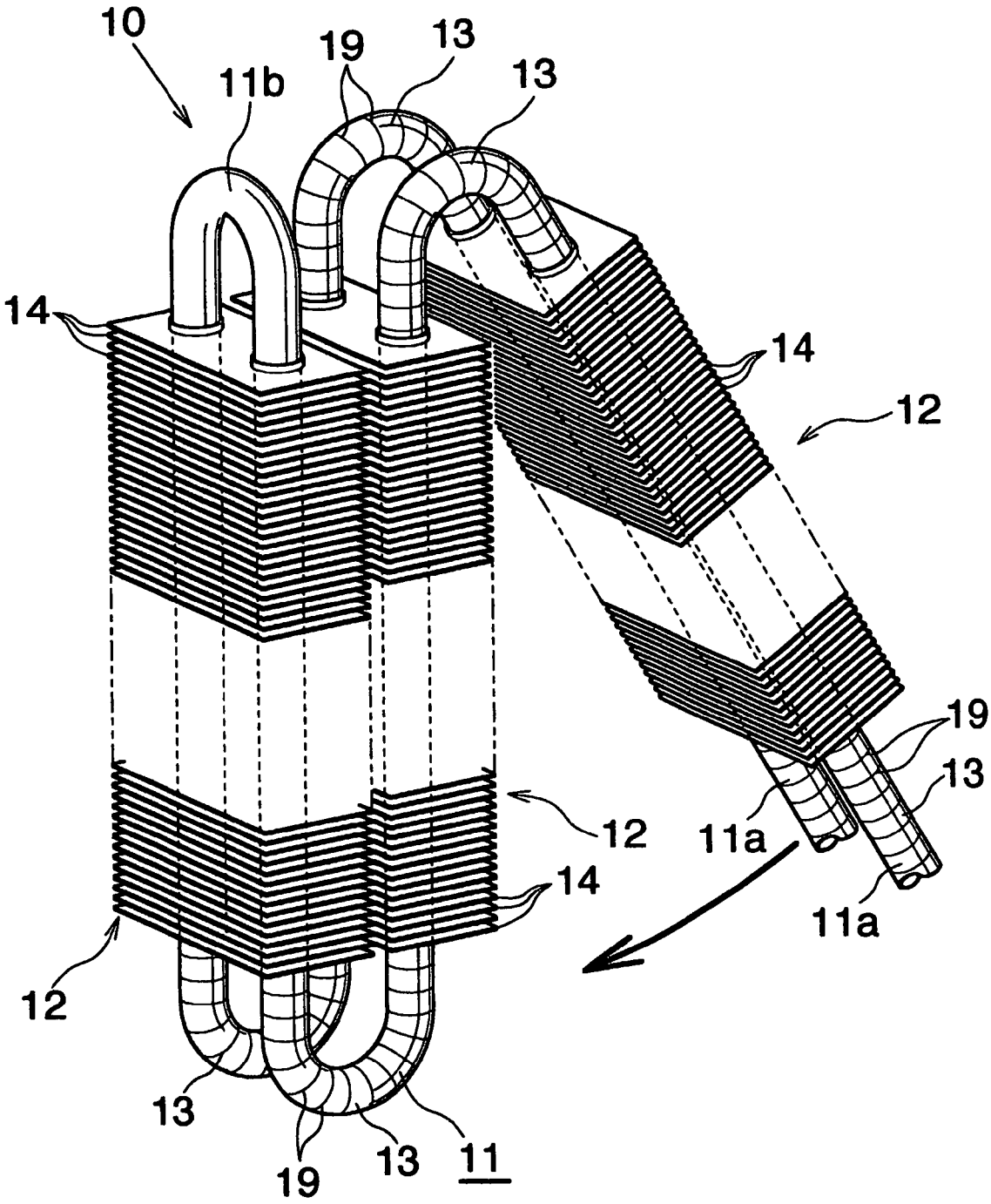
FIG. 9 is a fragmentary perspective view showing a process for fabricating a heat exchanger from the heat exchanger finned tube.
Figure 10:
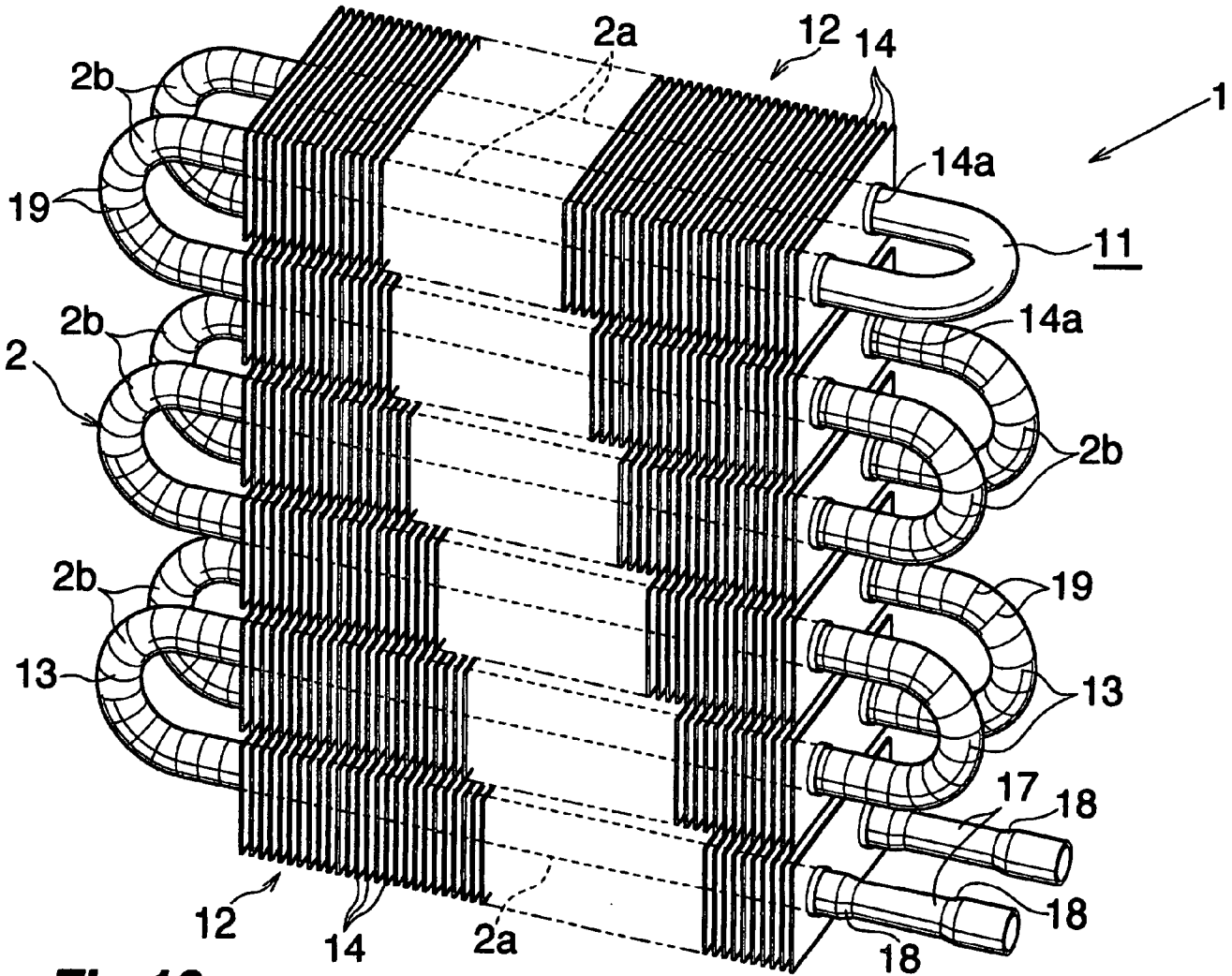
FIG. 10 is a perspective view showing the overall construction of the heat exchanger of the invention.

FIGS. 1 to 2 show a finned tube for use in heat exchangers, FIGS. 4 to 8 show an apparatus and a process for producing the finned tube, and FIG. 9 shows a process for fabricating a heat exchanger with the use of the finned tube. Further FIG. 10 shows the overall construction of the heat exchanger fabricated using the finned tube.

With reference to FIG. 1, a finned tube 10 for use in heat exchangers comprises a fin fixing hairpin tube 11 made of aluminum and comprising a tube having no weld seam, such as an extruded tube, and a plurality of fin groups 12 arranged on two straight tube portions 11*a* of the tube 11 longitudinally thereof at a spacing. The straight tube portions 11*a* each have a finless part 13 between each pair of adjacent fin groups 12 thereon. The fin group 12 comprises a plurality of parallel aluminum plate fins 14 extending across and fixed to the two straight tube portions 11*a* of the fin fixing tube 11.

With reference to FIG. 2, the fin fixing tube 11 is integrally provided with high and low two kinds of inner fins 15, 16 projecting from the inner peripheral surface of the tube to different heights, extending longitudinally thereof, and alternately arranged circumferentially thereof at a spacing. The inner fins 15, 16 project toward the center of the tube 11. The high inner fins 15 are 0.7 to 1.7 mm in height h1 as measured from the inner peripheral surface of the tube 11, and the low inner fins 31 are 0.4 to 1.2 mm in height h2 as measured from the surface of the tube 11. The pitch p of the inner fins 15, 16 is 0.4 to 1.6 mm. The pitch p of the inner fins 15, 16 is the circumferential distance, as measured in cross section on the outer periphery of the tube 11, between two straight lines connecting the center line of the tube 11 and the centers of the thicknesses of a pair of adjacent inner fins 15, 16. The fin fixing tube 11 is 6 to 10 mm in outside diameter of the portion thereof where plate fins 14 are fixed, and 0.4 to 0.8 mm in the thickness of the circumferential wall thereof.

The tube 11 has a bent portion 11*b* which is enlarged in its entirety and given the same diameter as the part of the straight tube portion 11*a* to which part the plate fins 14 are fixed to provide the fin group 12 at one end (rear end) of the tube portion 11*a* close to the bent portion 11*b*. The fin fixing tube 11 has a restrained small-diameter portion 17 having an outside diameter equal to or about 0.2 to 0.3 mm larger than that of the fin fixing tube 11 before enlargement, at a part closer to an opening thereof than the fin group 12 at an open end portion (front end portion) of the tube 11. The restrained small-diameter portion 17 has a length which is preferably, for example, at least 15 mm. The portion 17 is provided at each of its opposite ends with a tapered part 18 which is flared leftwardly or rightwardly outward.

Each of the plate fins 14 has two tube inserting holes 14*a* each provided with a collar 14*b* therearound. The two straight tube portions 1*a* of the fin fixing tube 11 are inserted through the respective holes 14*a* of all the plate fins 14, and the plate fins 14 are fixedly fitted around the straight tube portions 11*a* by enlarging the tube fixing tube 11 with a fluid such as water, oil or air.

Figure 3:
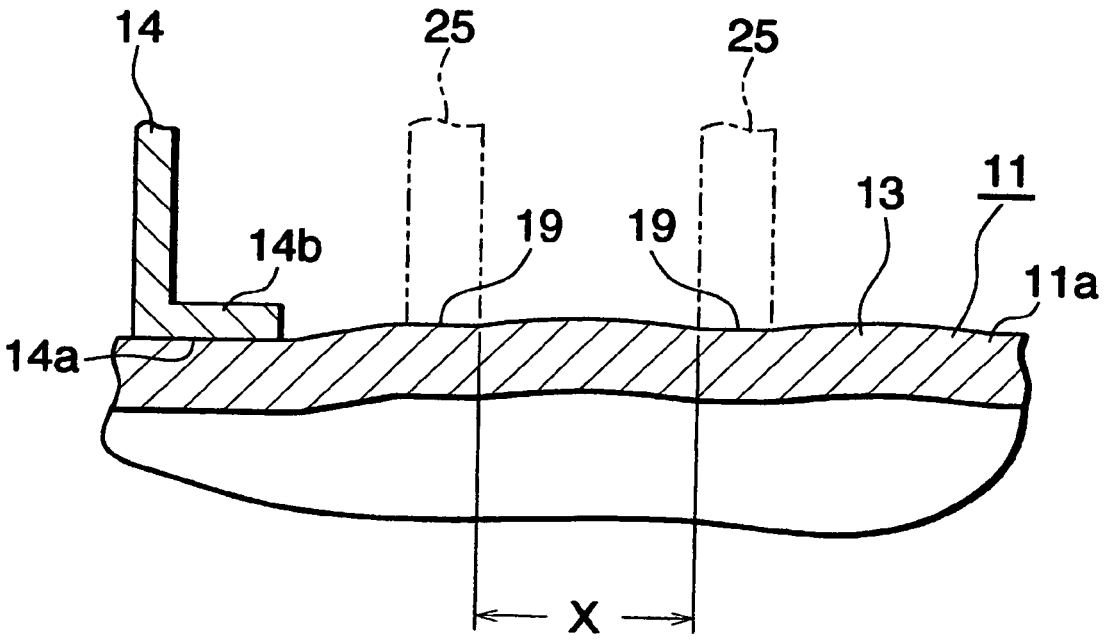
FIG. 3 is an enlarged fragmentary view in section of the finned tube of FIG. 1.

The finless parts 13 are in excess of 5 mm in length, and annular clamp marks 19 are produced on each finless part at a spacing longitudinally of the straight tube portion 11*a*. The spacing X (see FIG. 3) between each pair of adjacent clamp marks 19 on the finless part 13 and the distance between the clamp mark 19 and the plate fin 14 which are positioned at each end of the finless portion 13 are each up to 5 mm, with the result that the portions of the finless part 13 bearing no clamp mark 19 are not greater than 5 mm in length. The portions bearing no clamp mark 19 are limited to not greater than 5 mm in length so as to reliably prevent the fin fixing tube 11 from rupturing during enlargement. When the clamp mark 19 is observed microscopically, the entire circumferential wall of the straight tube portion 11*a* is slightly recessed at the marked part from the other part as shown in FIG. 3.

Figure 4:
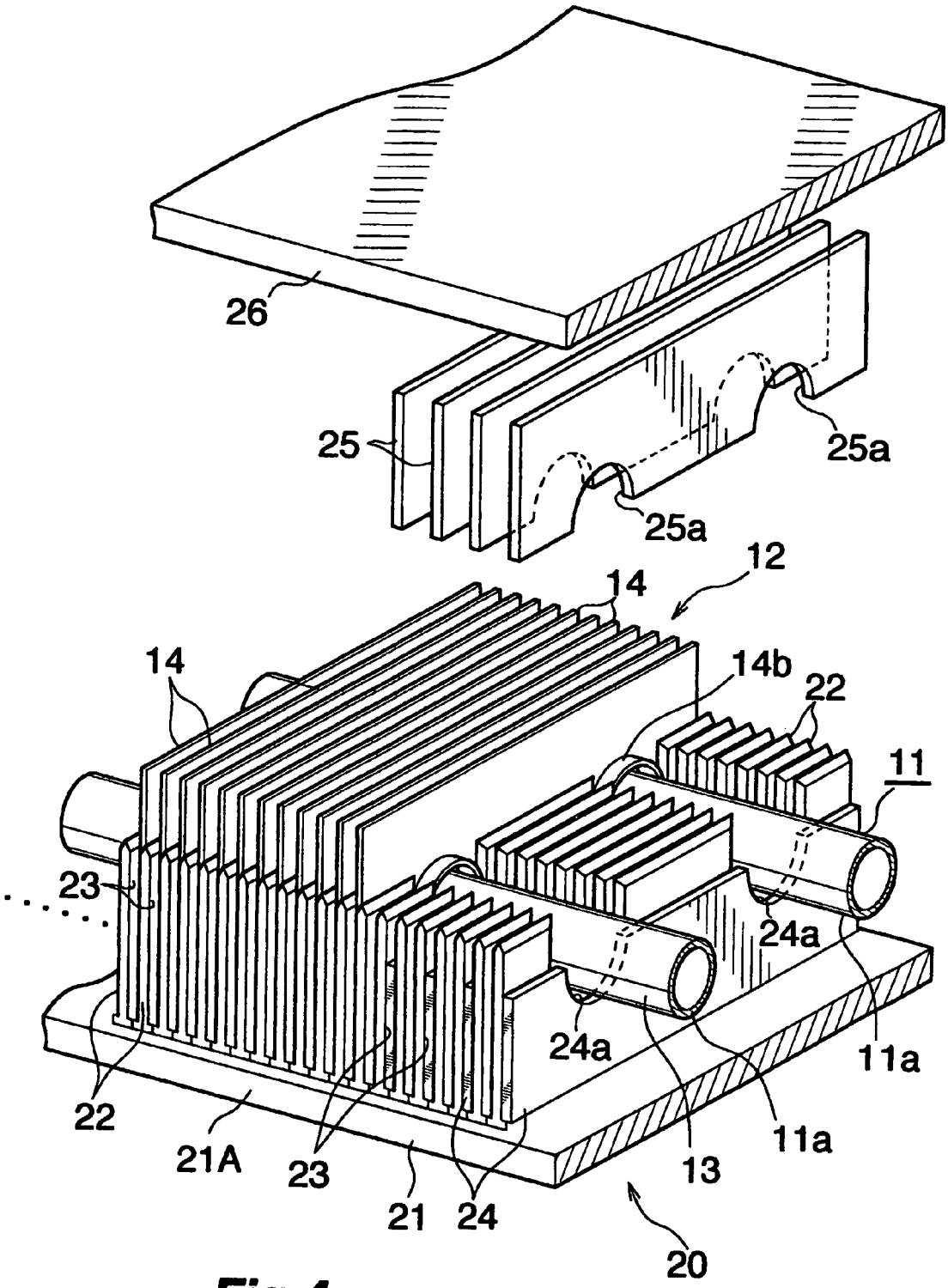
FIG. 4 is an enlarged perspective view partly showing an apparatus for producing the heat exchanger finned tube according to the invention.
Figure 5:
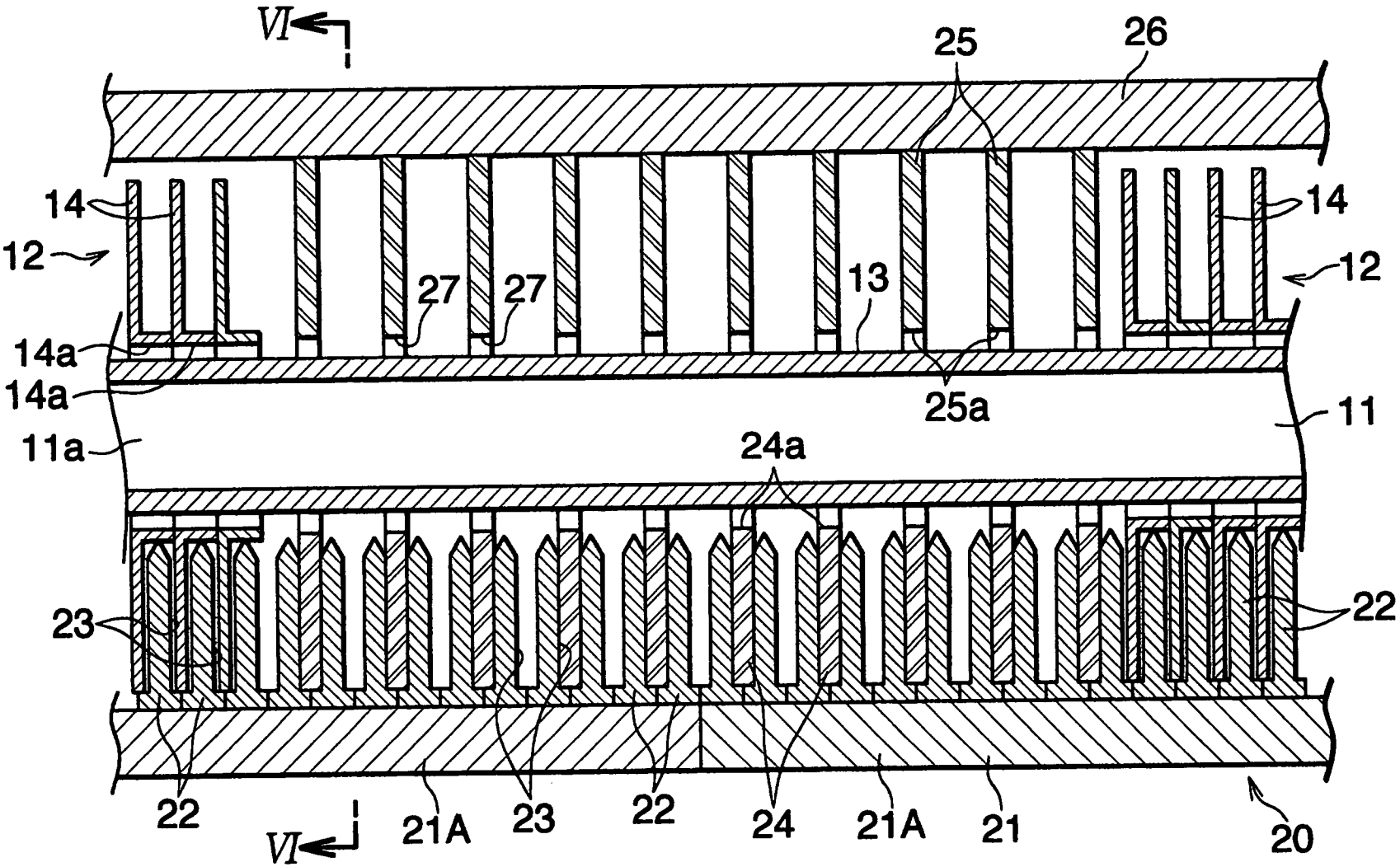
FIG. 5 is a view in vertical longitudinal section and partly showing a fin fixing tube and fins set in the apparatus of FIG. 4.
Figure 6:
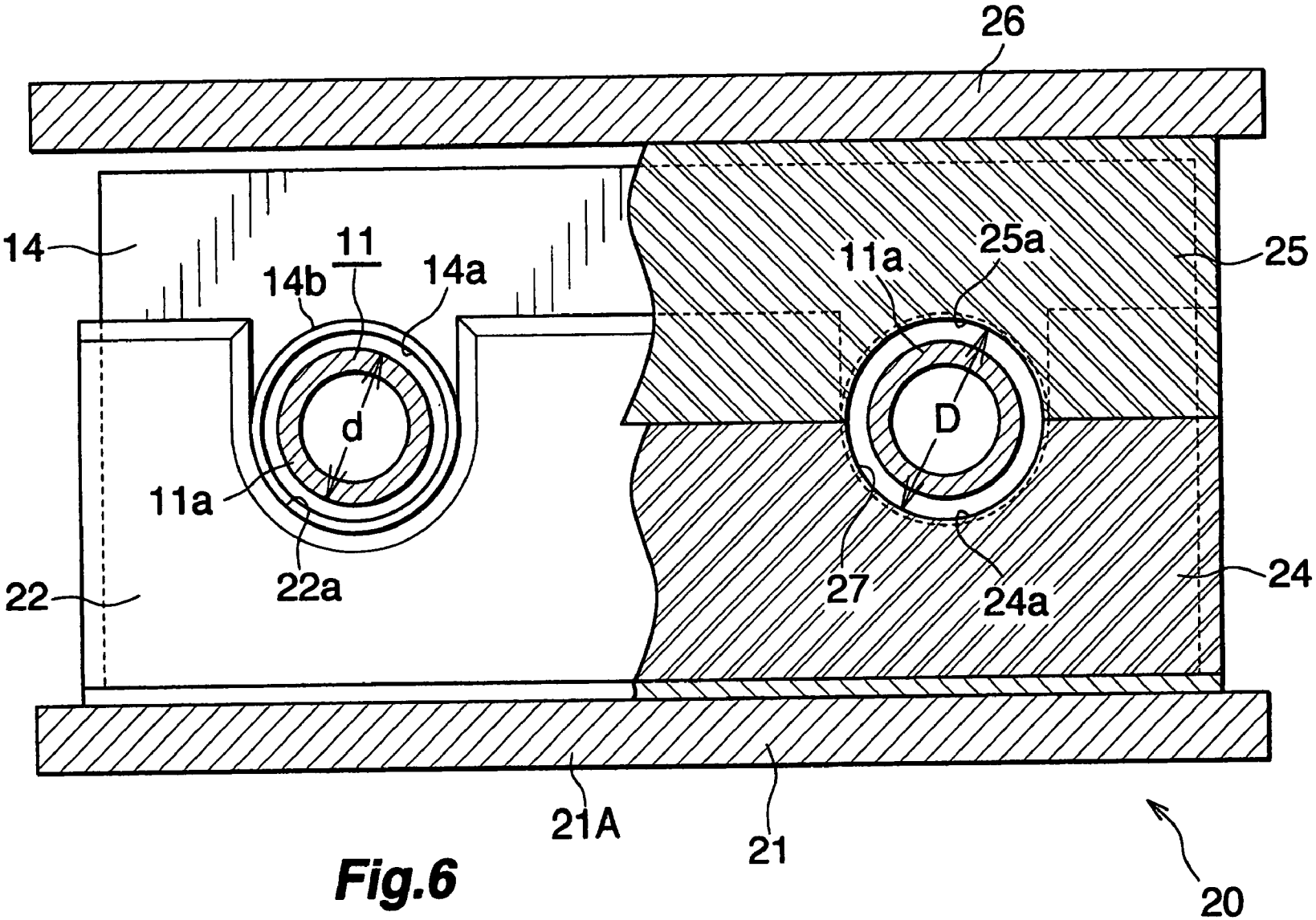
FIG. 6 is a view in section taken along the line VI—VI in FIG. 5 and partly cut away.

The finned tube 10 for use in heat exchangers is produced as shown in FIGS. 4 to 6 using the production apparatus shown in these drawings.

With reference to FIGS. 4 to 6, the production apparatus comprises a fin setting jig 20 composed of a forwardly or rearwardly elongated plate base 21 and a plurality of parallel fin support plates 22 provided upright on the plate base 21 and arranged at a spacing in the forward or rearward direction, tube clamp lower plates 24 arranged in respective fin setting clearances 23 between the adjacent fin support plates 22 of the jig 20, tube clamp upper plates 25 provided on the lower plates 24 arranged between the adjacent fin support plates 22, and a platelike pressure member 26 for pressing the upper plates 25.

The plate base 21 comprises a plurality of base units 21A arranged in series in the forward or rearward direction. Fin support plates 22 are provided upright on each of the base units 21A. Two cutouts 22*a* which are generally U-shaped for fitting the straight tube portions 11*a* of the tube 11 therein are formed in the upper edge of each support plate 22 and spaced apart leftward or rightward, i.e., laterally. The upper and lower plates 25, 24 are made, for example, of JIS SUS 304 and have a thickness preferably of 0.8 to 1.0 mm. If the upper and lower plates 25, 24 are less than 0.8 mm in thickness, conspicuous marks remain on the outer peripheral surface of the fin fixing tube as enlarged, while if the thickness is in excess of 1.0 mm, great fluid pressure will act on the plates 25, 24, giving rise to the necessity of increasing the load resistance of the plates. The upper edge of the tube clamp lower plate 24 and the lower edge of the upper plate 25 are each provided with two semicircular cutouts 24*a* or 25*a* as spaced apart laterally, whereby two circular through holes 27 for inserting the respective straight tube portions 11*a* of the fin fixing tube 11 therethrough are formed between the upper and lower plates 25, 24 with the same pitch as the two cutouts 22*a* in the fin support plate 22. The through holes 27 have an inside diameter not smaller than the outside diameter of the tube 11 before enlargement. Stated more specifically, suppose the inside diameter of the holes 27 is D, and the outside diameter of the straight tube portions 11*a* of the tube 11 is d before enlargement. It is then desired that these diameters have the relationship of $d \leqq D \leqq d+0.4$ mm because if $d>D$, the tube 11 can not be inserted through the holes 27, and further because if $D>d+0.4$ mm, the tube 11 can not be reliably prevented from rupturing when the tube 11 is enlarged with use of a fluid.

Prepared for the production of a heat exchanger finned tube 10 are a fin fixing aluminum tube 11 in the form of a tube having no weld seam, and a multiplicity of aluminum plate fins 14 each having two tube inserting holes 14*a* as spaced apart. The plate fins 14 are arranged in the respective fin setting clearances 23 arranged in succession at the portions where fin groups 12 are to be provided, among the fin setting clearances 23 between all the fin support plates 22 of the production apparatus described above. Subsequently, the tube clamp lower plates 24 are arranged in the respective fin setting clearances 23 having no plate fin 14 disposed therein. At this time, the spacing between each pair of adjacent lower plates 24 and the distance between the lower plate 24 and the plate fin 14 at each of opposite ends of the arrangements are adjusted to not greater than 5 mm. The two straight tube portions 11*a* of the fin fixing tube 11 are then inserted through the respective tube inserting holes 14*a* of all the plate fins 14 and fitted into the respective cutouts 22*a* of the fin support plates 22 to provide fin groups 12 each comprising a plurality of parallel plate fins 14 extending across the two straight tube portions 11*a* and finless parts 13. The tube clamp upper plates 25 are then arranged on the respective lower plates 24, with the straight tube portions 11*a* of the tube 11 extending through the respective through holes 27 formed between the pairs of plates 24, 25. The upper plates 25 are thereafter pressed downward by the pressure member 26 (see FIGS. 4 to 6). Suppose the combined area of contact of the tube clamp upper plates 25 with the fin fixing tube 11 is A [$m^2$], and the pressure of the fluid introduced into the fin fixing tube 11 is P [Pa]. The force to be applied by the pressure member 26 for pressing the upper plates 25 downward is then set at not smaller than A×P [N].

Incidentally, the outside diameter of the fin fixing tube 11 before enlargement, the wall thickness of the tube 11, the inside diameter of the tube inserting holes 27 of the plate fins 14 and the inside diameter of the through holes 27 formed between the tube clamp upper and lower plates 25, 24 are, for example, 8.0 mm, 0.61 mm, 8.3 mm and 8.4 mm, respectively.

Figure 7:
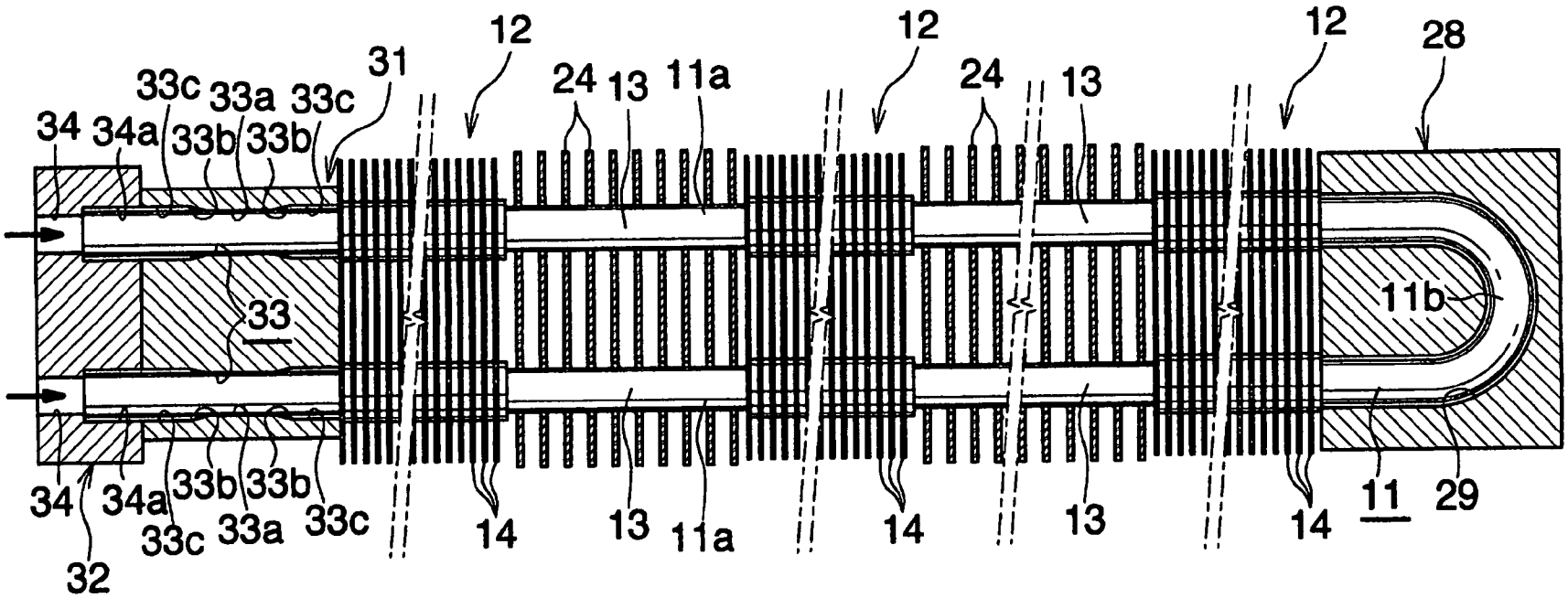
FIG. 7 is a view in horizontal section and partly broken away to show a process for producing the finned tube of FIG. 1 before the fin fixing tube is enlarged.
Figure 8:
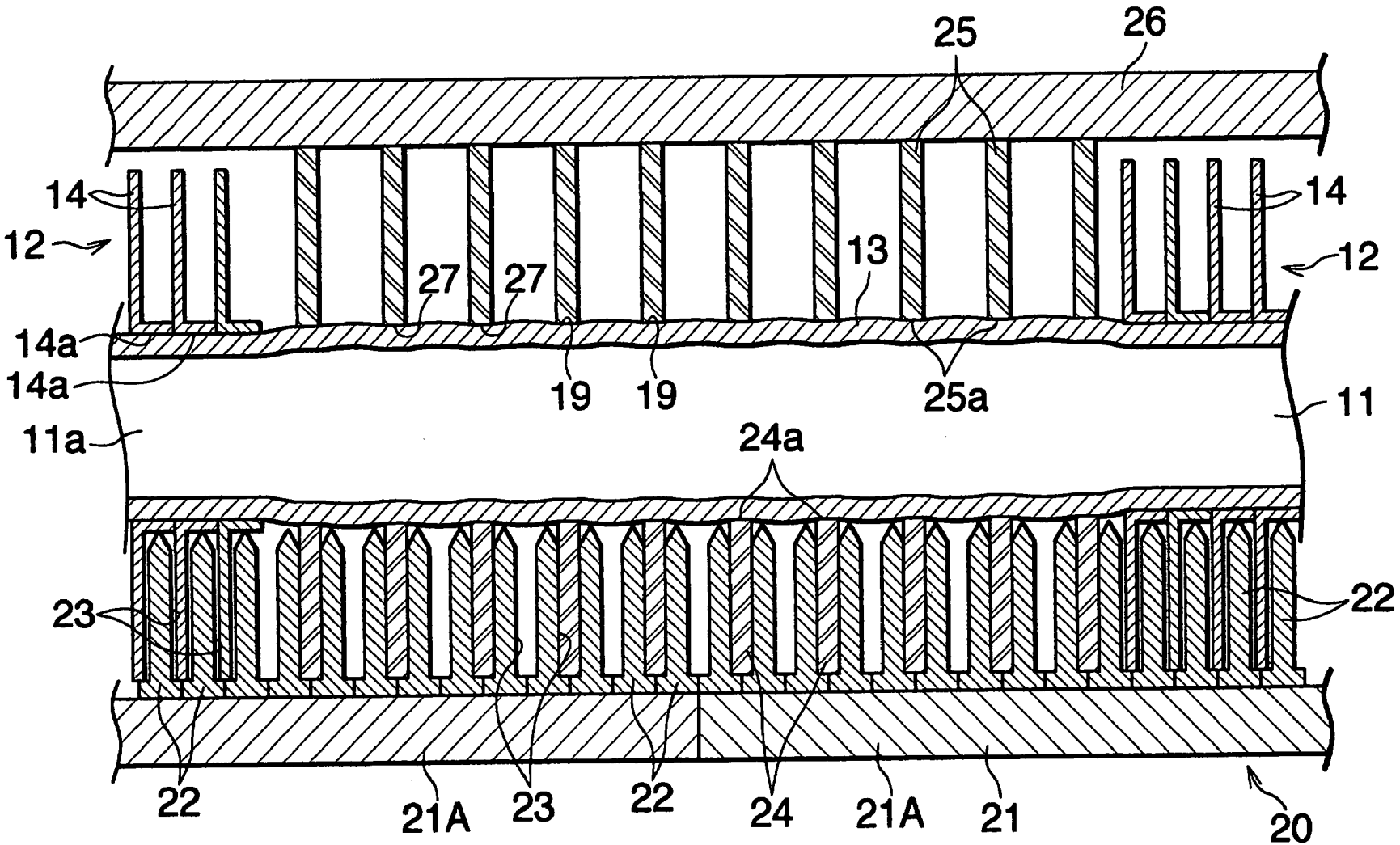
FIG. 8 is a sectional view corresponding to FIG. 5 and partly showing the fin fixing tube as enlarged in producing the finned tube of FIG. 1.

Further as shown in FIG. 7, the bent portion 11*b* of the fin fixing tube 11 is restrained by a restraining die 28. This die 28 has a U-shaped cavity 29 having a circular cross section. The cavity 29 has an inside diameter larger than the outside diameter of the tube 11 before enlargement and equal to the inside diameter of the tube inserting holes 14*a* of the plate fins 14. Furthermore, opposite ends of the fin fixing tube 11 are restrained by a tube chucking die 31, and a fluid pressure seal block 32 is joined to the die 31 in intimate contact therewith. The tube chucking die 31 has cavities 33, i.e., two hollow cylindrical restraining portions 33*a* spaced apart transversely of the tube 11 and having an inside diameter equal to the outside diameter of the tube 11 before enlargement, two tapered portions 33*b* communicating with respective opposite ends of each of the restraining portions 33*a* and having a diameter increasing laterally outward, and a tube enlargement permitting portion 33*c* in the form of a hollow short cylinder, communicating with the larger end of each tapered portion 33*b* and not smaller than the tube inserting holes 14*a* of the plate fins 14 in inside diameter. The seal block 32 has two fluid inlet channels 34 which are spaced apart laterally. The front half of each of the inlet channels 34 has an inside diameter smaller than the outside diameter of the tube 11 before enlargement. The rear half of the channel 34 has a large-diameter portion 34*a* adjacent to the front half with a stepped portion provided therebetween. The large-diameter portion 34*a* is equal to the enlargement permitting portion 33*c* of the tube chucking die 31 in inside diameter. The ends of the tube 11 are inserted into the large-diameter portions 34*a* of the fluid inlet channels 34 of the fluid pressure seal block 32, and their end faces are in intimate bearing contact with the stepped portions.

In this state, a pressure fluid comprising, for example, water, oil or air is introduced into the fin fixing tube 11 from the fluid inlet channels 34 of the seal block 32, enlarging the tube 11 except at the portions thereof restrained by the restraining portions 33*a* of the tube chucking die 31 to fixedly fit the plate fins 14 of the fin groups 12 around the straight tube portions 11*a* of the tube 11. During this enlargement, clamp marks 19 are left by the tube clamp upper and lower plates 25, 24 (see FIG. 8). In this way, the heat exchanger finned tube 10 is produced.

In the process described, the straight tube portions 11*a* of the fin fixing tube 11 are clamped at the finless parts 13 by the upper and lower plates 25, 24 during enlargement as described above and are therefore prevented from rupturing. Furthermore, the inner fins 15, 16 are prevented from collapsing since the tube is enlarged with the pressure fluid.

As shown in FIG. 9, the heat exchanger finned tube 10 is bent at the finless parts 13 between the adjacent fin groups 12, whereby the tube is formed zigzag in its entirety. FIG. 10 shows a heat exchanger 1 thus fabricated for use as an evaporator in refrigerators or refrigerated showcases. Stated more specifically, the straight tube portions 11*a* are bent in the same direction at the finless parts 13 which are located in the same position with respect to the longitudinal direction of the straight tube portions 11*a* so that a straight line through the lengthwise centers of the parts 13 will be the center of the curvature, and each pair of finless parts 13 adjacent to each other longitudinally of the straight tube portions 11*a* are bent in different directions, whereby the tube 11 is bent zigzag in its entirety.

With reference to FIG. 10, the heat exchanger 1 comprises a zigzag heat exchange tube 2 comprising a fin fixing tube 11 bent zigzag, and fin groups 12 provided around the straight tube portions 2*a* of the zigzag heat exchange tube 2 and each comprising a plurality of parallel plate fins 14. A plurality of bent portions 2*b* at the left and right sides of the zigzag heat exchange tube 2 each comprise a finless part 13. Although not shown, the bent portions 2*b* of the tube 2 at the left and right are held by respective side plates.

The heat exchanger 1 is used as the evaporator of a refrigerator which is provided with a refrigeration cycle having a compressor, condenser and evaporator, and wherein a hydrocarbon refrigerant is used as the refrigerant. In this refrigerator, the refrigerant is circulated at a low rate of 1 to 9 kg/h.

The heat exchanger 1 is used also as the evaporator of a refrigerated showcase which is provided with a refrigeration cycle having a compressor, condenser and evaporator, and wherein a hydrocarbon refrigerant is used as the refrigerant. In this refrigerated showcase, the refrigerant is circulated at a low rate of 1 to 9 kg/h.

Figure 11:
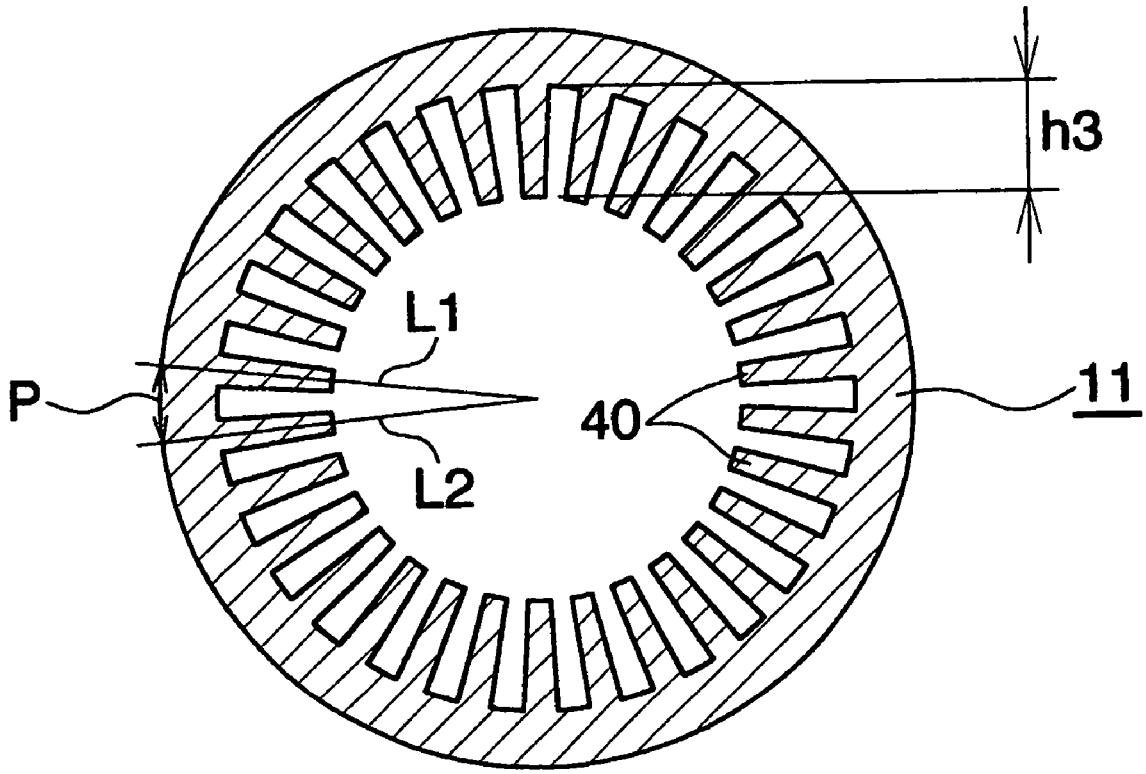
FIG. 11 is a sectional view corresponding to FIG. 2 and showing another embodiment of heat exchanger finned tube.

FIG. 11 shows another embodiment of heat exchanger finned tube.

With reference to FIG. 11, a fin fixing tube 11 is integrally provided with a plurality of inner fins 40 projecting from the inner peripheral surface of the tube to equal heights, extending longitudinally thereof, and arranged circumferentially thereof at a spacing. The inner fins 40 are 0.7 to 1.2 mm in height h3 as measured from the inner peripheral surface of the fin fixing tube 11. The inner fins 40 have the same pitch p as those already described. At the tube portions fixedly provided with the plate fins 14, the tube 11 is 6 to 10 mm in outside diameter, and 0.4 to 0.8 mm in the thickness of the circumferential wall thereof.

INDUSTRIAL APPLICABILITY

The heat exchanger finned tube of the invention is suitable for fabricating a heat exchanger, for example, for use as the evaporator of a refrigeration cycle which is included in a refrigerator or refrigerated showcase and wherein a hydrocarbon refrigerant is used.

The invention claimed is:

1. A heat exchanger finned tube which has a fin fixing tube having a straight tube portion and comprising a tube having no weld seam, and a fin group comprising a plurality of parallel plate fins fixed to the straight tube portion of the fin fixing tube, the straight tube portion having at least one finless part provided with no fin group, each of the plate fin having a tube inserting hole, the fin fixing tube having its straight tube portion inserted through the holes of the plate fins and being enlarged with use of a fluid to thereby fixedly fit the plate fins around the straight tube portion, the finless part of the straight tube portion having an outer peripheral surface bearing annular clamp marks left by clamping the straight tube portion over the entire circumference thereof when the fin fixing tube is enlarged.

2. A heat exchanger finned tube according to claim 1 wherein the fin fixing tube is in the form of a hairpin, and a plurality of fin groups are arranged on two straight tube portions of the fin fixing tube longitudinally thereof at a spacing, each of the fin groups comprising a plurality of parallel plate fins extending across and fixed to the two straight tube portions, each of the plate fins having two tube inserting holes spaced apart from each other, the fin fixing tube having its straight tube portions inserted through the respective holes of the plate fins, the two straight tube portions of the fin fixing tube each having the finless part between each pair of adjacent fin groups.

3. A heat exchanger finned tube according to claim 1 wherein the finless part is in excess of 5 mm in length, and portions bearing no clamp mark and included in the finless part are up to 5 mm in length.

4. A heat exchanger finned tube according to claim 1 wherein the fin fixing tube is integrally provided on an inner peripheral surface thereof with inner fins extending longitudinally thereof and arranged at a spacing circumferentially thereof.

5. A heat exchanger finned tube according to claim 4 wherein the fin fixing tube has high and low two kinds of inner fins alternately arranged circumferentially thereof and projecting from the inner peripheral surface of the tube to different heights, the high inner fins being 0.7 to 1.7 mm in height from the surface of the fin fixing tube, the low inner fins being 0.4 to 1.2 mm in height from the surface.

6. A heat exchanger finned tube according to claim 4 wherein all the inner fins are equal in height and 0.7 to 1.2 mm in height from the inner peripheral surface of the fin fixing tube.

7. A heat exchanger finned tube according to claim 5 or 6 wherein the pitch of the inner fins is 0.4 to 1.6 mm.

8. A heat exchanger comprising a heat exchanger finned tube which has a fin fixing tube having a straight tube portion and comprising a tube having no weld seam, and a fin group comprising a plurality of parallel plate fins fixed to the straight tube portion of the fin fixing tube, the straight tube portion having at least one finless part provided with no fin group, each of the plate fin having a tube inserting hole, the fin fixing tube having its straight tube portion inserted through the holes of the plate fins and being enlarged with use of a fluid to thereby fixedly fit the plate fins around the straight tube portion, the finless part of the straight tube portion having an outer peripheral surface bearing annular clamp marks left by clamping the straight tube portion over the entire circumference thereof when the fin fixing tube is enlarged, the heat exchanger finned tube being bent at said at least one finless part of the straight tube portion of the fin fixing tube.

9. A heat exchanger comprising a heat exchanger finned tube which has a fin fixing hairpin tube having two straight tube portions and comprising a tube having no weld seam, and a plurality of fin groups arranged on the two straight tube portions of the fin fixing tube longitudinally thereof at a spacing, each of the fin groups comprising a plurality of parallel plate fins extending across and fixed to the two straight tube portions, each of the straight tube portions having at least one finless part provided with no fin group, each of the plate fins having two tube inserting holes spaced apart from each other, the fin fixing tube having its straight tube portions inserted through the respective holes of the plate fins and being enlarged with use of a fluid to thereby fixedly fit the plate fins around the straight tube portions, the two straight tube portions of the fin fixing tube each having the finless part between each pair of adjacent fin groups, the finless part of each straight tube portion having an outer peripheral surface bearing annular clamp marks left by clamping the straight tube portion over the entire circumference thereof when the fin fixing tube is enlarged, the finned tube being formed in a zigzag shape in its entirety by bending in the same direction each pair of finless parts located in the same position with respect to the longitudinal direction of the straight tube portions of the fin fixing tube, and bending in different directions each pair of finless parts adjacent to each other longitudinally of the straight tube portions.

10. A refrigerator which comprises a refrigeration cycle having a compressor, a condenser and an evaporator, the evaporator being a heat exchanger according to claim 8 or 9, and wherein a hydrocarbon refrigerant is used as the refrigerant.

11. A refrigerated showcase which comprises a refrigeration cycle having a compressor, a condenser and an evaporator, the evaporator being a heat exchanger according to claim 8 or 9, and wherein a hydrocarbon refrigerant is used as the refrigerant.

12. An apparatus for producing a heat exchanger finned tube comprising a fin setting jig composed of a plate base and a plurality of fin support plates provided upright on the plate base and arranged in parallel at a spacing, tube clamp lower plates arranged in respective fin setting clearances between adjacent fin support plates of the fin setting jig, tube clamp upper plates arranged on the respective lower plates between the adjacent fin support plates and a pressure member for pressing the upper plates downward, each of the fin support plates having a cutout formed in an upper edge thereof for a straight tube portion of a fin fixing tube to fit in, each pair of corresponding tube clamp upper and lower plates having a through hole formed therebetween for inserting the straight tube portion of the fin fixing tube therethrough, the through hole having an inside diameter not smaller than the outside diameter of the fin fixing tube.

13. An apparatus for producing a heat exchanger finned tube according to claim 12 wherein each of the fin support plates has two cutouts formed as spaced apart in the upper edge thereof for two straight tube portions of a fin fixing hairpin tube to fit in, and each pair of corresponding tube clamp upper and lower plates have two through holes formed therebetween for inserting the two straight tube portions of the fin fixing tube therethrough, the through holes having the same pitch as the two cutouts.

14. An apparatus for producing a heat exchanger finned tube according to claim 12 wherein the plate base of the fin setting jig comprises a plurality of base units arranged in series, and fin support plates are provided upright on each of the base units.

15. An apparatus for producing a heat exchanger finned tube according to claim 12 wherein the tube clamp upper and lower plates are each 0.8 to 1.0 mm in thickness.

16. A process for producing a heat exchanger finned tube according to claim 1 which process includes preparing a fin fixing tube having a straight tube portion and comprising a tube having no weld seam, and a plurality of plate fins each having a tube inserting hole, arranging the plate fins in respective fin setting clearances arranged in succession at a portion where a fin group is to be provided, among fin setting clearances between all fin support plates of a production apparatus according to claim 12, arranging tube clamp lower plates in the respective fin setting clearances having no plate fin disposed therein, inserting the straight tube portion of the fin fixing tube through the tube inserting holes of the plate fins and fitting the straight tube portion into cutouts of the fin support plates to provide on the straight tube portion a fin group comprising the plate fins as arranged in parallel and a finless part, arranging tube clamp upper plates on the respective tube clamp lower plates, with the straight tube portion of the tube extending through a hole formed between each pair of corresponding upper and lower plates, pressing the upper plates downward by a pressure member, and introducing a fluid into the fin fixing tube to enlarge the tube and fixedly fit the plate fins of the fin group around the straight tube portion.

17. A process for producing a heat exchanger finned tube according to claim 2 which process includes preparing a fin fixing hairpin tube comprising a tube having no weld seam, and plate fins each having two tube inserting holes, arranging the plate fins in respective fin setting clearances arranged in succession at portions where respective fin groups are to be provided, among fin setting clearances between all fin support plates of a production apparatus according to claim 13, arranging tube clamp lower plates in the respective fin setting clearances having no plate fin disposed therein, inserting two straight tube portions of the fin fixing tube through the respective tube inserting holes of each of the plate fins and fitting the straight tube portions respectively into two cutouts of each of the fin support plates to provide fin groups each comprising a plurality of plate fins as arranged in parallel and finless parts, arranging tube clamp upper plates on the respective tube clamp lower plates, with the straight tube portions of the tube extending respectively through two holes formed between each pair of corresponding upper and lower plates, pressing the upper plates downward by a pressure member, and introducing a fluid into the fin fixing tube to enlarge the tube and fixedly fit the plate fins of the fin groups around the straight tube portions.

18. A process for producing a heat exchanger finned tube according to claim 16 or 17 wherein assuming that the hole formed between the corresponding tube clamp upper and lower plates has an inside diameter D, and that the straight tube portion of the fin fixing tube before enlargement has an outside diameter d, these diameters have the relationship of $d \leqq D \leqq d+0.4$ mm.

19. A process for producing a heat exchanger finned tube according to claim 16 or 17 wherein assuming that the combined area of contact of the tube clamp upper plates with the fin fixing tube is A, and that the pressure of the fluid introduced into the fin fixing tube is P, the force to be applied by the pressure member for pressing the upper plates downward is set at not smaller than $A \times P$.

20. A process for producing a heat exchanger finned tube according to claim 16 or 17 wherein the fin fixing tube is integrally provided on an inner peripheral surface thereof with inner fins extending longitudinally thereof and arranged at a spacing circumferentially thereof.

21. A heat exchanger finned tube according to claim 20 wherein the fin fixing tube has high and low two kinds of inner fins alternately arranged circumferentially thereof and projecting from the inner peripheral surface of the tube to different heights, the high inner fins being 0.7 to 1.7 mm in height from the surface of the fin fixing tube, the low inner fins being 0.4 to 1.2 mm in height from the surface.

22. A heat exchanger finned tube according to claim 20 wherein all the inner fins are equal in height and 0.7 to 1.2 mm in height from the inner peripheral surface of the fin fixing tube.

* * * * *